United States Patent [19]

Howard et al.

[11] 4,164,391

[45] Aug. 14, 1979

[54] CONVEYOR FOR PROCESSING

[75] Inventors: Walter D. Howard; David I. McDonald, both of Cincinnati, Ohio

[73] Assignee: Cincinnati Milacron Inc., Cincinnati, Ohio

[21] Appl. No.: 887,752

[22] Filed: Mar. 17, 1978

[51] Int. Cl.[2] ..... F27B 9/14

[52] U.S. Cl. ..... 432/124; 198/472; 198/604; 198/695

[58] Field of Search ..... 432/121, 124; 198/472, 198/604, 695

[56] References Cited

U.S. PATENT DOCUMENTS

| | | | |
|---|---|---|---|
| 2,897,772 | 8/1959 | Hunter | 198/472 |
| 4,113,082 | 9/1978 | Timin | 198/472 |

FOREIGN PATENT DOCUMENTS

| | | | |
|---|---|---|---|
| 512134 | 4/1976 | U.S.S.R. | 198/695 |

*Primary Examiner*—John J. Camby
*Attorney, Agent, or Firm*—Daniel P. Worth

[57] ABSTRACT

A conveyor apparatus for carrying workpieces on flat trays has two parallel chains with tray supports connected at equal intervals between the two chains. Each tray support has a clamping device for clamping and releasing flat silicone rubber covered trays against itself. Cams are located between the chains to operate the clamping device to release the tray (for travel through a separate path) at one point in travel and later (when the tray returns from its separate path) to clamp it again. The conveyor is shown as combined with up-and-down elevator means in an oven to give a boustrophedontic path to a plurality of workpieces being heated on trays in the oven: the trays are released and clamped at the entrance to and exit from the oven to allow movement of the trays by the elevators through up and down paths at the release and clamping stations.

13 Claims, 8 Drawing Figures

TO 8,10
TO 22

CONVEYOR FOR PROCESSING

SUMMARY AND BACKGROUND OF THE INVENTION

This invention relates to a conveyor for automatic processing of workpieces. One specific aspect by way of example and not limitation relates to a conveyor for the automatic heating, in an oven relying mainly on forced convection, of many square thin flat chips of polypropylene to a suitable temperature in connection with which the invention will be described.

An object of this invention is to provide means for conveying flat workpieces on removable trays on an endless type of conveyor through one or more processes.

In summary, the invention embraces a conveyor of the endless type having means for clamping and releasing carrier trays that comprises—a pair of parallel and spaced apart endless conveyors such as belts or chains and preferably (as described e.g. hereafter) chains, a plurality of annular rectangular frames connected to and between said chains at equally spaced-apart distances along each and having substantially flat upwardly facing support surfaces; at least one clamping means mounted on each said frame to clamp and release a carrier tray means thereto, a machine base from which said chains are supported to run longitudinally each in an endless path; and a clamp actuator in the form of a fixed cam mounted on said base at a position to engage each of said clamping means seriatim to cause it to release its tray at one position and to clamp its respective tray at another position, said clamping means and clamp actuators coacting to hold the clamping means in an unclamped position over a certain part of the path of said chains and to cause them to move to a clamped position during the other part of the path. In the preferred embodiment, a plurality of such carrier trays and each said carrier tray is a flat perforated member silicone rubber covered on at least one side.

Other objects, uses, advantages, and features may become evident from the following specification and annexed drawings wherein FIG. 1 is a side elevation view, partially schematic, showing an oven in which is used a conveyor according to the present invention;

Figure 1:
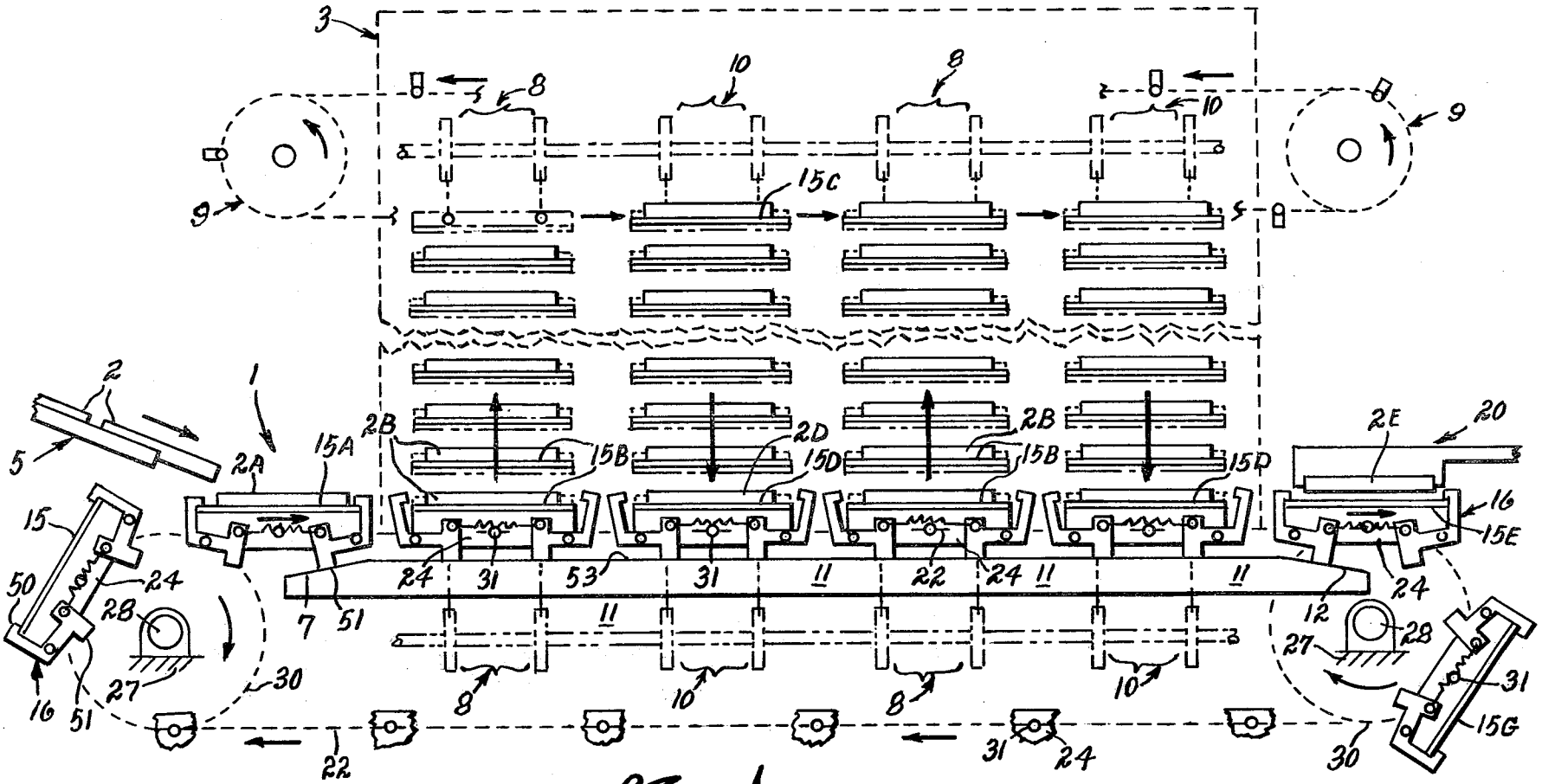

FIG. 1 shows a processing conveyor 1 according to this invention for conveying workpieces 2 in a step-by-step manner through a processing chamber 3, preferably (and hereinafter) an oven. The workpieces 2 are, e.g. ⅛ inch thick, 2 inch square polypropylene blanks, to be heated to biaxial orientation temperature in the range from about ambient to about 500° F. for shaping into a container or other article.

The system of FIG. 1 (from left to right) has a load station 5, release cam 7, up-elevator and tray removal means 8, upper horizontal transfer conveyor or shuttle 9, down elevator and tray return means 10, a lower level horizontal transfer station 11, trays 15, and then another series of trays and up-stuttle-down-and-advance-means (like numbered), and finally clamping cam and unload station 12,20.

A blank 2 is fed manually or automatically to the load station 5 where it is placed on a clamped tray (at) 15A (postscripts A,B. . .E etc. designate the station or position that each tray 15 passed through and likewise for workpieces 2 at 2A. . .E etc.) that is standing still temporarily. The conveyor 1 is then indexed and everything moves one station forward hence the blank 2 and tray are moved through release cam station 7 and stop at up-elevator station 8. Simultaneously, at the upper level, another tray 15*c* is moved horizontally by transfer means 9. The clamping means 16 is moved to a release portion (clamp jaws spread see station 8 positions) by engaging the cam 7. While the conveyor 1 stops the blank at up elevator 8, the indexing drive operates the up-elevator one position to lift or remove the tray (at) 15B with blank 2 thereon to the first up-elevator stop. The entire procedure repeats itself for the next blank arriving at loader 5, i.e., the conveyor 1 indexes and moves one station at a time, dwelling after each index; during each dwell a tray 15B is lifted up at each up-station 8 and tray 15D is returned to the conveyor 1 at each down elevator; also, the exiting tray 15E at the unload station 12 is clamped by the cam 12 during movement thereto and the exiting workpiece 2E thereon is unloaded manually or by a suitable means 20 during the dwell interval at unload station 12,20. The clamped tray 15E at station 12,20 is thus enabled to return to the load station 5 in an indexing manner while being held on (upside down e.g. 15G) the roller chain conveyor.

The conveyor 1 of the invention includes means for clamping and releasing carrier trays that comprises—a pair of parallel and spaced apart endless conveyor means such as belts but preferably chains 22, a plurality of annular rectangular frames or tray support means (FIGS. 4, 7) 24 connected to said chains at substantially equally spaced-apart distances along each and having substantially flat upwardly facing support surfaces 25; at least one clamping means 16 mounted on each said frame to clamp and release a carrier tray means 15 thereto, a machine base 27 including shafts 28 carrying sprockets 30 from which said chains are supported to run longitudinally each in an endless path; and a clamp actuator 7,12 in the form of a fixed cam comprising a straight bar with sloping ends mounted on said base at a position to engage each of said clamping means seriatum to cause it to release its tray at one position (cam 7) and to clamp its respective tray (cam 12) at another position, said clamping means and clamp actuators coacting to hold the clamping means in an unclamped (i.e., tray released) position over a certain part of the path of said chains and to cause them to move to a clamped position during the other part of the path.

Figures 2, 3, 4, 5, 6, 7, 8:
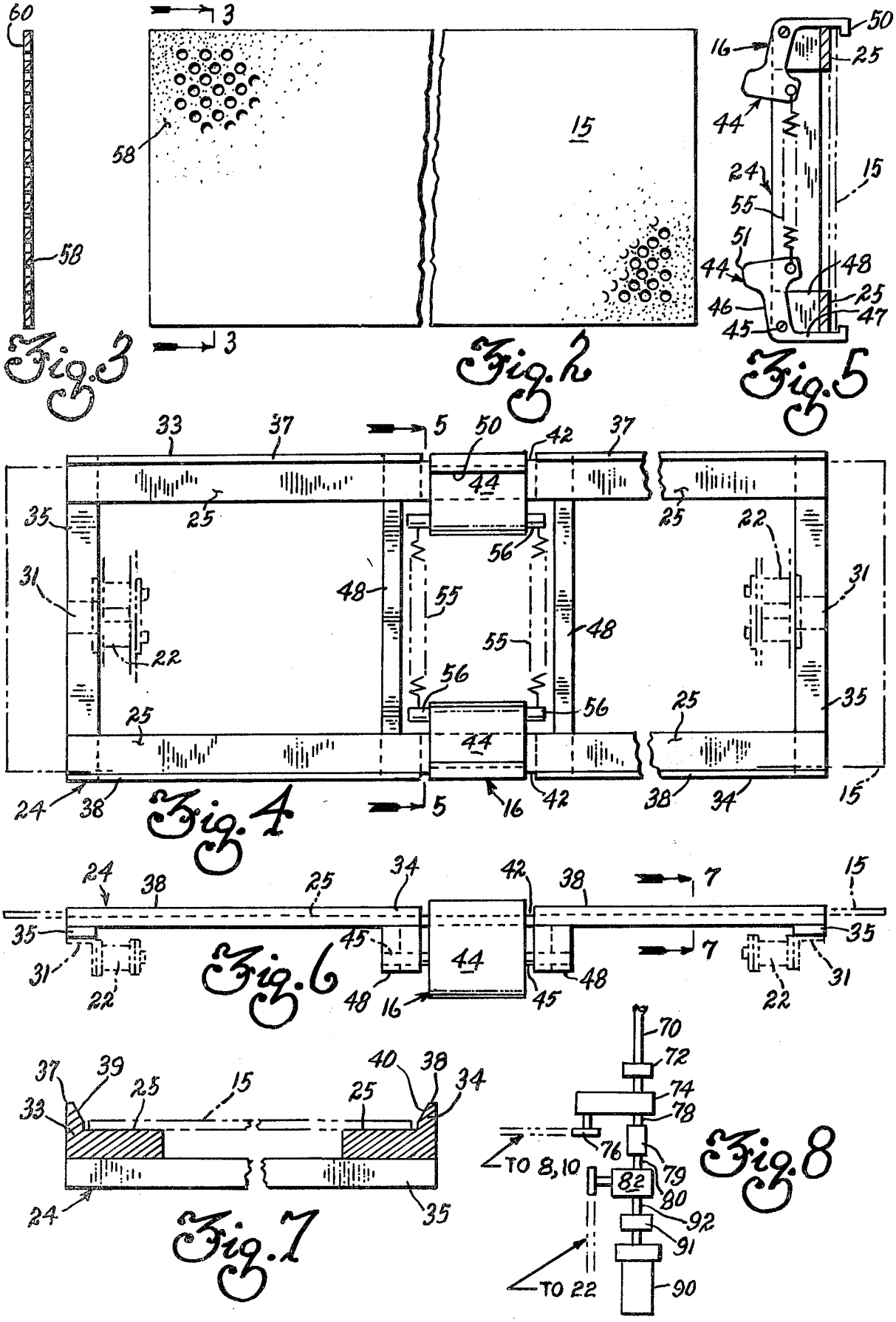
FIG. 2 is a top view of the flat rubber covered perforated tray used with the FIG. 1 apparatus.
FIG. 3 is a tray cross-section along 3—3 of FIG. 2.
FIG. 4 is a top view of one of the tray support(s) of the FIG. 1 apparatus.
FIG. 5 is a tray support center section through 5—5 of FIG. 4.
FIG. 6 is an end view (e.g. from the right or left of FIG. 1) of the tray of FIG. 5.
FIG. 7 is tray support side cross-section along 7—7 of FIG. 6.
FIG. 8 is a schematic diagram of a drive system for the FIG. 1 assemblage.

The chains 22 are conventional roller chains with attachment clips or lugs 31 secured at equally-spaced locations along each chain (FIGS. 4 and 6). Lugs 31 are shaped substantially like a short piece of angle iron and provide the means for securing to the chains 22 the tray support means or frames 24. Also, the lugs on each chain are aligned laterally opposite a corresponding lug on the other chain to give support to the tray support means 24 that are secured thereto.

Each tray support means 24 comprises a leading edge spar 33, trailing edge spar 34, and two end spars 35 defining an annular rectangular frame 24 that is rigid, presents on the spars flat horizontal upper surface(s) 25 on which the trays 15 rest.

On the forwardmost and rearmost edges of the leading and trailing spars are provided locating railings 37,38 which are each basically a vertically extending rail having a sloping inner face 39,40 (FIG. 7) that acts to guide the tray to its correct location on the tray support, thus bringing the trays on the conveyor 22 and supports 24 into register with the coacting components at e.g. stations 8, 10, 11, 12 and likewise workpieces especially at 12. The sloping faces converge toward the middle of the support means. These locating rails are cutaway at the centermost part (42 generally, FIG. 4 only) of the support in order to provide the necessary clearance (FIGS. 4, 5 and 6) for clamping jaws 44.

Clamping jaws 44 are a pair of bell cranks each pivotally mounted at the central part of the tray support 24. Each bell crank is pivoted about a mounting shaft 45 at the junction of its two arms 46,47. The respective mounting shafts extend laterally to engagement with depending center ribs 48 (FIGS. 4,5,6) which are mounted one on each side of the clamping jaws.

Each clamping jaw has on arm 47 an upper lip 50 that overhangs the tray 15 as best seen in FIGS. 1,4,5 to enhance the holding function against the tray (dotted lines FIGS. 4–7). The other arm 46 terminates in a cam follower 51 (FIG. 5) that engages the release 7, holding-open cam 53, and clamping face 12 of the elongated cam or clamp actuator of FIG. 1.

Finally, resilient biasing means, namely a pair of laterally spaced-apart helical springs 55 bias the clamping jaws to a clamping position. Preferably, the springs are hooked to mounting studs 56 on the upper side of the bell crank cam arm.

The carrier tray 15 preferably has a resilient covering on its upper side, most preferably a rubber covered perforated metal member. The rubber 58 need only cover one side and increases the coefficient of friction with the workpiece to minimize or eliminate sliding of the workpiece responsive to inertia forces. Perforated metal for tray base 60 is an item that can be purchased on the market. The rubber is preferably a room temperature vulcanizing (RTV) silicone composition of the sort made and sold by a number of companies, such as General Electric Company, Schenectady, NY, who sells such materials for a coating, sealant or adhesive and preferably is General Electric RTV 106 silicone composition for use in high temperature (500° to 600° F.) environments such as those of the FIG. 1 oven.

FIG. 8 shows a preferred drive for the oven system of FIG. 1. Of course, the conveyor of the invention may be driven by a number of different drives, FIG. 8 being presently preferred and exemplary.

Main drive shaft 70 is preferably a power takeoff from a downstream machine such as unload means 20, or the like. To insure sychronizing of events between downstream and the oven, a single point clutch 72 receives the drive from the shaft 70 and delivers it to a Geneva drive 74 that divides the drive into two outputs 76 and 78. Output 76 is typical Geneva periodic motion, provides 90° of motion and 270° of dwell for each 360° of input rotation, and thus intermittantly drives the up and down elevators 8,10. Further, details to achieve the elevator action, such as direction reversals, drives on each side, etc. are known in the art, e.g. U.S. Pat. No. 3,993,189.

Geneva output 78 goes into an axially and angularly adjustable coupling 79 at the same angular velocity as the input 70,72. The coupling 79 connects by shaft 80 to the input of an indexing drive 82 the purpose of which is to convert continuous rotary input to discontinuous or intermittant output—here to convert 360° of input rotation to 270° of motion (to move the upper and lower horizontal drives 9,22 indexingly) and 90° of dwell (during which dwell the up and down elevators pick up trays from and return trays 15 to the lower conveyor as a 8,10). Preferably the 270° input rotation is converted to 60° of output rotation for advancing 9,22.

Finally, there is an auxiliary drive consisting of an electric motor 90, a friction clutch 91, and an auxiliary drive shaft 92. Normally, this is not operated, the drive being from shaft 70. But during set up, adjustment, etc. it may be desired to operate the oven or conveyor without operating unload means 20 or other downstream machinery. To do this, disengage clutch 72, engage clutch 91, and turn on motor 90.

It will thus be appreciated that the present conveyor provides a longitudinally extending means that can release and then clamp at selected position a tray 15 upon which workpieces 2 are carried. As a matter of convenience in claim terminology, we here refer to the entering path (7,8) from a load through and including the up elevator station as a first horizontal path, the up elevator station itself as a first vertical path and a first direction, the upper horizontal or shuttle path as a second horizontal path, and the down elevator as a second vertical in a second direction opposite to the first path direction. Finally, the exiting path from the station which includes the final down elevator (indeed it may even be the first down elevator if only a short oven residence time is desired) to unload station is known as a third horizontal path.

Thus, for example, flat square polypropylene chips may be heated to a preselected temperature preparatory to further shaping into a product: if a retortable container is contemplated then to above biaxial orientation temperature but if a cold pack procedure is to follow then to orientation temperature. Similarly, as to treatment of various materials by heat or atmosphere (e.g. annealing or heating of metals and non-metals, baking, case hardening or some metals, etc.)

What is claimed is:

1. In combination with an oven having in its interior conveyor means to move seriatim trays for supporting workpieces along a first horizontal path at the workpiece inlet and into the oven, thence through a first vertical path in a first direction, then a second horizontal path, a second vertical path in a second direction opposite to said first path direction and sometime thereafter along a third horizontal path to the workpiece outlet, the moves on said first and third horizontal paths being by engagement with an endless conveyor means extending through said oven, the improvement that comprises a plurality of annular frames supported at substantially equally spaced-apart distances along said endless conveyor means, each frame presenting a flat upper surface for supporting a flat tray;

a clamping means carried by each of said frames for clamping at least one of said trays to its corresponding said frame;

a clamp actuator having a tray release means and a tray clamping means each of which engages a portion of said clamping means;

said tray release means for unclamping said clamping means prior to releasing one of said trays for movement along said first vertical path, and said tray clamping means for clamping a tray to engage it to move along said third horizontal path with said conveyor means and to return in endless fashion from said third horizontal path to said first horizontal path.

2. In the combination of claim 1 the improvement that comprises a plurality of said trays;

said trays being substantially flat, and said tray release and tray clamping means being adapted to respectively release and engage substantially flat trays.

3. In the combination of claim 1 the improvement that comprises a plurality of said trays;

said trays being covered on at least their workpiece engaging face with a silicone rubber.

4. In the combination of claim 1 the improvement that comprises a plurality of said trays;

said trays being substantially flat and covered on at least their workpiece engaging face with a silicone rubber; and said tray release and tray engaging means being adapted to respectively release and engage substantially flat trays.

5. In the combination of claim 4, the improvement comprising—said trays being perforated.

6. In the combination of claim 2, the improvement comprising—said trays being perforated.

7. The apparatus of claim 1, wherein said clamp actuator further comprises first and second cams that respectively constitute said tray release means and tray clamping means.

8. A conveyor of the endless type having means for clamping and releasing carrier trays that comprises a pair of parallel and spaced aprt endless chains;

a plurality of annular rectangular frames connected to said chains at equally spaced-apart distances along each and having substantially flat upwardly facing support surfaces;

at least one clamping means mounted on each said frame to clamp and release a carrier tray means thereto;

a machine base from which said chains are supported to run longitudinally each in an endless path;

and a clamp actuator in the form of a fixed cam mounted on said base at a position to engage each of said clamping means seriatim to cause it to unclamp its tray at one position and to clamp its respective tray at another position;

said clamping means and clamp actuators coacting to hold the clamping means in an unclamped position over a certain part of the path of said chains and to cause said clamping means to move to an unclamped position during the other part of the path.

9. A conveyor according to claim 8 further comprising a plurality of such carrier trays, each said carrier tray being a flat perforated member with a resilient covering on at least one side.

10. A conveyor according to claim 8 where each said frame has tray locating means located on its leading and trailing edges whereby a tray received therein is directed to its position.

11. A conveyor means according to claim 10 wherein said locating means comprises wedge-shaped lateral guides extending up from said flat upwardly facing surfaces.

12. A conveyor means according to claim 8 wherein said clamping means comprises a pair of opposed jaws located respectively on the leading and trailing edges of said frame or support, means on said support for supporting each of said jaws to pivot about an axis below said frame, a spring means which biases said jaws to a closed position, and a cam follower on each jaw underneath said support located to engage and be actuated by said clamp actuator as aforesaid.

13. Conveyor means according to claim 12 where each said frame has tray locating means located on its leading and trailing edges whereby a tray received therein is directed to the position in which it is to be clamped.

* * * * *